US008863700B2

(12) United States Patent
Fang et al.

(10) Patent No.: US 8,863,700 B2
(45) Date of Patent: Oct. 21, 2014

(54) FUEL ADDITIVE FOR IMPROVED PERFORMANCE IN FUEL INJECTED ENGINES

(71) Applicant: Afton Chemical Corporation, Richmond, VA (US)

(72) Inventors: Xinggao Fang, Midlothian, VA (US); Scott D. Schwab, Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 0 days.

(21) Appl. No.: 13/666,226

(22) Filed: Nov. 1, 2012

(65) Prior Publication Data

US 2013/0333650 A1 Dec. 19, 2013

Related U.S. Application Data

(63) Continuation of application No. 13/495,471, filed on Jun. 13, 2012.

(51) Int. Cl.

| | |
|---|---|
| ***F02B 43/00*** | (2006.01) |
| ***C10L 1/22*** | (2006.01) |
| ***C10L 1/2383*** | (2006.01) |
| ***C10L 10/18*** | (2006.01) |
| ***C10L 1/224*** | (2006.01) |
| ***C10L 10/08*** | (2006.01) |

(52) U.S. Cl.

CPC ..... *C10L 1/221* (2013.01); *C10L 2270/026* (2013.01); *C10L 2270/02* (2013.01); *C10L 2230/22* (2013.01); *C10L 2200/0476* (2013.01); *C10L 1/2383* (2013.01); *C10L 10/18* (2013.01); *F02B 43/00* (2013.01); *C10L 1/224* (2013.01); *C10L 10/08* (2013.01)

USPC ..... 123/1 A; 44/408; 44/409; 44/456; 44/422; 44/399; 44/400; 44/356

(58) Field of Classification Search

USPC ..... 123/1 A; 44/408, 409, 456, 422, 399, 44/400, 356

See application file for complete search history.

(56) References Cited

U.S. PATENT DOCUMENTS

| | | | | |
|---|---|---|---|---|
| 2,129,264 | A | 9/1938 | Baxter et al. | |
| 2,886,423 | A | 5/1959 | Vitalis et al. | |
| 3,015,668 | A | 1/1962 | Kozikowski | |
| 3,027,246 | A | 3/1962 | Bartlett | |
| 3,468,640 | A | 9/1969 | Barusch et al. | |
| 3,778,371 | A | 12/1973 | Malec | |
| 4,056,531 | A | 11/1977 | Malec | |
| 4,152,499 | A | 5/1979 | Boerzel | |
| 4,171,959 | A | 10/1979 | Vartanian | |
| 4,234,435 | A | 11/1980 | Meinhardt et al. | |
| 4,248,719 | A | 2/1981 | Chafetz et al. | |
| 4,253,980 | A | 3/1981 | Hammond et al. | |
| 4,326,973 | A | 4/1982 | Hammond et al. | |
| 4,338,206 | A | 7/1982 | Hammond et al. | |
| 4,482,357 | A | 11/1984 | Hanlon | |
| 4,787,916 | A | 11/1988 | Feldman | |
| 5,254,138 | A | 10/1993 | Kurek | |
| 5,575,823 | A | 11/1996 | Wallace et al. | |
| 5,752,989 | A | 5/1998 | Henly et al. | |
| 7,297,675 | B2 | 11/2007 | Allef et al. | |
| 7,906,470 | B2 | 3/2011 | Stevenson et al. | |
| 7,947,093 | B2 | 5/2011 | Barton et al. | |
| 7,951,211 | B2 | 5/2011 | Barton et al. | |
| 2003/0131527 | A1 | 7/2003 | Colucci et al. | |
| 2004/0029766 | A1 * | 2/2004 | Frick et al. | 510/499 |
| 2005/0120619 | A1 * | 6/2005 | Koch et al. | 44/301 |
| 2008/0113890 | A1 | 5/2008 | Moreton et al. | |
| 2008/0307698 | A1 * | 12/2008 | Barton et al. | 44/321 |
| 2010/0024286 | A1 | 2/2010 | Smith et al. | |

(Continued)

FOREIGN PATENT DOCUMENTS

| | | | |
|---|---|---|---|
| EP | 0293192 | B1 | 11/1991 |
| EP | 2033945 | A1 | 3/2009 |

(Continued)

OTHER PUBLICATIONS

The Lubrizol Corporation Article: "The CEC DW10 Diesel Fuel Injector Fouling Test" published on 2010. Web Page Link: http://www.lubrizol.com/9040Zer0/DW10TechBulletin.pdf PDF File Attached: "DW10TechBulletin.pdf".*

*Primary Examiner* — Hung Q Nguyen

*Assistant Examiner* — Ruben Picon-Feliciano

(74) *Attorney, Agent, or Firm* — Luedeka Neely Group, P.C.

(57) ABSTRACT

In accordance with the disclosure, exemplary embodiments provide a fuel additive concentrate, a method for cleaning fuel injectors, a method for restoring power to a diesel fuel injected engine, a fuel composition, and a method of operating a fuel injected diesel engine. The additive concentrate includes (a) a hydrocarbyl substituted quaternary ammonium internal salt; and (b) a reaction product of (i) a hydrocarbyl substituted dicarboxylic acid, anhydride, or ester and (ii) an amine compound or salt thereof of the formula

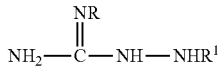

wherein R is selected from hydrogen and a hydrocarbyl group containing from about 1 to about 15 carbon atoms, and $R^1$ is selected from hydrogen and a hydrocarbyl group containing from about 1 to about 20 carbon atoms. The reaction product (b) on average has less than 2 amino-triazole groups per molecule. A weight ratio of (a) to (b) in the additive concentrate ranges from about 10:1 to about 1:10.

21 Claims, No Drawings

(56) References Cited

U.S. PATENT DOCUMENTS

| | | | | |
|---|---|---|---|---|
| 2010/0037513 | A1 | 2/2010 | Petrucci et al. | |
| 2010/0037514 | A1* | 2/2010 | Malfer et al. | 44/343 |
| 2010/0151396 | A1* | 6/2010 | Papachristos et al. | 431/4 |
| 2010/0236510 | A1 | 9/2010 | Shea et al. | |
| 2011/0258917 | A1 | 10/2011 | Garcia Castro et al. | |
| 2011/0315107 | A1 | 12/2011 | Grabarse et al. | |
| 2012/0010112 | A1 | 1/2012 | Grabarse et al. | |
| 2012/0138004 | A1 | 6/2012 | Stevenson et al. | |

FOREIGN PATENT DOCUMENTS

| | | | |
|---|---|---|---|
| WO | 2010132259 | A1 | 11/2010 |
| WO | 2011095819 | A1 | 8/2011 |
| WO | 2011110860 | A1 | 9/2011 |
| WO | 2011141731 | A1 | 11/2011 |
| WO | 2011149799 | A1 | 12/2011 |

* cited by examiner

FUEL ADDITIVE FOR IMPROVED PERFORMANCE IN FUEL INJECTED ENGINES

RELATED APPLICATION

This application is a continuation of application Ser. No. 13/495,471, filed Jun. 13, 2012, now pending.

TECHNICAL FIELD

The disclosure is directed to fuel additives and to additive and additive concentrates that include the additive that are useful for improving the performance of fuel injected engines. In particular the disclosure is directed to a synergistic fuel additive that is effective to enhance the performance of fuel injectors for internal combustion engines.

BACKGROUND AND SUMMARY

It has long been desired to maximize fuel economy, power and driveability in vehicles while enhancing acceleration, reducing emissions, and preventing hesitation. While it is known to enhance gasoline powered engine performance by employing dispersants to keep valves and fuel injectors clean in port fuel injection engines, such gasoline dispersants are not necessarily effective fuel injected diesel engines and may not be as effective in low sulfur fuels. The reasons for this unpredictability lie in the many differences between the fuel compositions that are suitable for such engines.

Additionally, new engine technologies require more effective additives to keep the engines running smoothly. Additives are required to keep the fuel injectors clean or clean up fouled injectors for spark and compression type engines. Engines are also being designed to run on alternative renewable fuels. Such renewal fuels may include fatty acid esters and other biofuels which are known to cause deposit formation in the fuel supply systems for the engines. Such deposits may reduce or completely bock fuel flow, leading to undesirable engine performance.

Some additives, such as quaternary ammonium salts that have cations and anions bonded through ionic bonding, have been used in fuels but may have reduced solubility in the fuels and may form deposits in the fuels under certain conditions of fuel storage or engine operation. Conventional quaternary ammonium salts may not be effective for use in diesel fuels containing components derived from renewable sources. Certain quaternary ammonium salts may not be effective for use in petroleum-based diesel fuels. Accordingly, there continues to be a need for fuel additives that are effective in cleaning up fuel injector or supply systems and maintaining the fuel injectors operating at their peak efficiency.

Also, low sulfur fuels and ultra low sulfur fuels are now common in the marketplace for internal combustion engines. A "low sulfur" fuel means a fuel having a sulfur content of 50 ppm by weight or less based on a total weight of the fuel. An "ultra low sulfur" fuel means a fuel having a sulfur content of 15 ppm by weight or less based on a total weight of the fuel. Low sulfur fuels tend to form more deposits in engines than conventional fuels, for example, because of the need for additional friction modifiers and/or corrosion inhibitors in the low sulfur fuels.

In accordance with the disclosure, exemplary embodiments provide a fuel additive concentrate for use in injected fuel engines, a method for cleaning fuel injectors for an internal combustion engine, a method for restoring power to a diesel fuel injected engine, a fuel composition, a method for improving performance of fuel injectors, and a method of operating a fuel injected diesel engine. The additive concentrate includes (a) a hydrocarbyl substituted quaternary ammonium internal salt; and (b) a reaction product derived from (i) a hydrocarbyl substituted dicarboxylic acid, anhydride, or ester and (ii) an amine compound or salt thereof of the formula

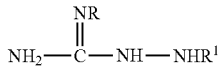

wherein R is selected from the group consisting of hydrogen and a hydrocarbyl group containing from about 1 to about 15 carbon atoms, and $R^1$ is selected from the group consisting of hydrogen and a hydrocarbyl group containing from about 1 to about 20 carbon atoms. The reaction product (b) on average has less than 2 amino-triazole groups per molecule. One weight ratio of (a) to (b) in the additive concentrate ranges from about 10:1 to about 1:10.

Another embodiment of the disclosure provides a method of improving the injector performance of a fuel injected diesel engine. The method includes operating the engine on a fuel composition that includes a major amount of fuel and from about 5 to about 500 ppm by weight based on a total weight of the fuel of a synergistic fuel additive. The synergistic fuel additive includes (a) a hydrocarbyl substituted quaternary ammonium internal salt; and (b) a reaction product derived from (i) a hydrocarbyl substituted dicarboxylic acid, anhydride, or ester and (ii) an amine compound or salt thereof of the formula

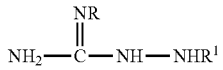

wherein R is selected from the group consisting of hydrogen and a hydrocarbyl group containing from about 1 to about 15 carbon atoms, and $R^1$ is selected from the group consisting of hydrogen and a hydrocarbyl group containing from about 1 to about 20 carbon atoms. The reaction product (b) on average has less than 2 amino-triazole groups per molecule. A weight ratio of (a) to (b) in the fuel additive ranges from about 10:1 to about 1:10. With the synergistic additive(s) present in the fuel, in one embodiment, at least about 90% of the power lost during a dirty up phase (when no inventive additive(s) is present in the fuel) of a CEC F98-08 DW10 test is recovered.

A further embodiment of the disclosure provides a method of operating a fuel injected engine. The method includes combusting in the engine a fuel composition containing a major amount of fuel and from about 5 to about 500 ppm by weight based on a total weight of the fuel of a synergistic fuel additive. The synergistic fuel additive includes (a) a hydrocarbyl substituted quaternary ammonium internal salt; and (b) a reaction product derived from (i) a hydrocarbyl substituted dicarboxylic acid, anhydride, or ester and (ii) an amine compound or salt thereof of the formula

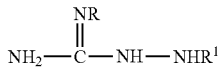

wherein R is selected from the group consisting of hydrogen and a hydrocarbyl group containing from about 1 to about 15 carbon atoms, and $R^1$ is selected from the group consisting of hydrogen and a hydrocarbyl group containing from about 1 to about 20 carbon atoms. The reaction product (b) on average has less than 2 amino-triazole groups per molecule. A weight ratio of (a) to (b) in the fuel additive ranges from about 10:1 to about 1:10.

An advantage of the fuel additive described herein is that the additive may not only reduce the amount of deposits forming on fuel injectors, but the additive may also be effective to clean up dirty fuel injectors sufficient to provide improved power recovery to the engine. The combination of components (a) and (b) in a fuel may be synergistically more effective for improving injector performance and power recovery (power restoration) than each of the components (a) and (b) alone in the fuel.

Additional embodiments and advantages of the disclosure will be set forth in part in the detailed description which follows, and/or can be learned by practice of the disclosure. It is to be understood that both the foregoing general description and the following detailed description are exemplary and explanatory only and are not restrictive of the disclosure, as claimed.

DETAILED DESCRIPTION OF EXEMPLARY EMBODIMENTS

Components (a) and (b) of the fuel additive may be used in a minor amount in a major amount of fuel and may be added to the fuel directly or added as components of an additive concentrate to the fuel.

Component (a)

Component (a) of the fuel additive for improving the operation of internal combustion engines may be made by a wide variety of well known reaction techniques with amines or polyamines. For example, such additive component (a) may be made by reacting a tertiary amine of the formula

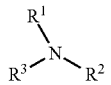

wherein each of $R^1$, $R^2$, and $R^3$ is selected from hydrocarbyl groups containing from 1 to 200 carbon atoms, with a halogen substituted $C_2$-$C_8$ carboxylic acid, ester, amide, or salt thereof. What is generally to be avoided in the reaction is quaternizing agents selected from the group consisting of hydrocarbyl substituted carboxylates, carbonates, cyclic-carbonates, phenates, epoxides, or mixtures thereof. In one embodiment, the halogen substituted $C_2$-$C_8$ carboxylic acid, ester, amide, or salt thereof may be selected from chloro-, bromo-, fluoro-, and iodo-$C_2$-$C_8$ carboxylic acids, esters, amides, and salts thereof. The salts may be alkali or alkaline earth metal salts selected from sodium, potassium, lithium calcium, and magnesium salts. A particularly useful halogen substituted compound for use in the reaction is the sodium or potassium salt of a chloroacetic acid.

As used herein, the term "hydrocarbyl group" or "hydrocarbyl" is used in its ordinary sense, which is well-known to those skilled in the art. Specifically, it refers to a group having a carbon atom directly attached to the remainder of a molecule and having a predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, amino, alkylamino, and sulfoxy);

(3) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as carbonyl, amido, imido, pyridyl, furyl, thienyl, ureyl, and imidazolyl. In general, no more than two, or as a further example, no more than one, non-hydrocarbon substituent will be present for every ten carbon atoms in the hydrocarbyl group; in some embodiments, there will be no non-hydrocarbon substituent in the hydrocarbyl group.

As used herein, the term "major amount" is understood to mean an amount greater than or equal to 50 wt. %, for example from about 80 to about 98 wt. % relative to the total weight of the composition. Moreover, as used herein, the term "minor amount" is understood to mean an amount less than 50 wt. % relative to the total weight of the composition.

As used herein the term "substantially devoid of free anion species" means that the anions, for the most part are covalently bound to the product such that the reaction product as made does not contain any substantial amounts of free anions or anions that are ionically bound to the product. In one embodiment, "substantially devoid" means from 0 to less than about 2 wt. % of anion species.

As used herein the term "ultra-low sulfur" means fuels having a sulfur content of 15 ppm by weight or less.

In one embodiment, a tertiary amine including monoamines and polyamines may be reacted with the halogen substituted acetic acid or derivative thereof to provide component (a). Suitable tertiary amine compounds of the formula

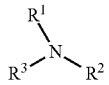

wherein each of $R^1$, $R^2$, and $R^3$ is selected from hydrocarbyl groups containing from 1 to 200 carbon atoms may be used. Each hydrocarbyl group $R^1$ to $R^3$ may independently be linear, branched, substituted, cyclic, saturated, unsaturated, or contain one or more hetero atoms. Suitable hydrocarbyl groups may include, but are not limited to alkyl groups, aryl groups, alkylaryl groups, arylalkyl groups, alkoxy groups, aryloxy groups, amido groups, ester groups, imido groups, and the like. Particularly suitable hydrocarbyl groups may be linear or branched alkyl groups. Some representative examples of amine reactants which can be reacted to yield compounds of this invention are: trimethyl amine, triethyl amine, tri-n-propyl amine, dimethylethyl amine, dimethyl lauryl amine, dimethyl oleyl amine, dimethyl stearyl amine, dimethyl eicosyl amine, dimethyl octadecyl amine, N-methyl piperidine, N,N'-dimethyl piperazine, N-methyl-N-ethyl piperazine, N-methyl morpholine, N-ethyl morpholine, N-hydroxyethyl morpholine, pyridine, triethanol amine, triisopropanol amine, methyl diethanol amine, dimethyl ethanol amine, lauryl diisopropanol amine, stearyl diethanol amine, dioleyl ethanol amine, dimethyl isobutanol amine, methyl diisooctanol amine, dimethyl propenyl amine, dimethyl butenyl amine, dimethyl octenyl amine, ethyl didodecenyl amine, dibutyl eicosenyl amine, triethylene diamine, hexamethylene tetramine, N,N,N',N'-tetramethylethylenediamine, N,N,N',N'-tetramethylpropylenediamine, N,N,N',N'-tetraethyl-1,3-propanediamine, methyldicyclohexyl amine, 2,6-dimethylpyridine, dimethylcylohexylamine, $C_{10}$-$C_{30}$-alkyl or alkenyl-substituted amidopropyldimethylamine, $C_{12}$-$C_{200}$-alkyl or alkenyl-substituted succinic-carbonyldimethylamine, and the like.

If the amine contains solely primary or secondary amino groups, it is necessary to alkylate at least one of the primary or secondary amino groups to a tertiary amino group prior to the reaction with the halogen substituted $C_2$-$C_8$ carboxylic acid, ester, amide, or salt thereof. In one embodiment, alkylation of primary amines and secondary amines or mixtures with tertiary amines may be exhaustively or partially alkylated to a tertiary amine. It may be necessary to properly account for the hydrogens on the nitrogens and provide base or acid as required (e.g., alkylation up to the tertiary amine requires removal (neutralization) of the hydrogen (proton) from the product of the alkylation). If alkylating agents, such as, alkyl halides or dialkyl sulfates are used, the product of alkylation of a primary or secondary amine is a protonated salt and needs a source of base to free the amine for further reaction.

The halogen substituted $C_2$-$C_8$ carboxylic acid, ester, amide, or salt thereof for use in making component (a) may be derived from a mono-, di-, or trio-chloro-bromo-, fluoro-, or iodo-carboxylic acid, ester, amide, or salt thereof selected from the group consisting of halogen-substituted acetic acid, propanoic acid, butanoic acid, isopropanoic acid, isobutanoic acid, tert-butanoic acid, pentanoic acid, heptanoic acid, octanoic acid, halo-methyl benzoic acid, and isomers, esters, amides, and salts thereof. The salts of the carboxylic acids may include the alkali or alkaline earth metal salts, or ammonium salts including, but not limited to the Na, Li, K, Ca, Mg, triethyl ammonium and triethanol ammonium salts of the halogen-substituted carboxylic acids. A particularly suitable halogen substituted carboxylic acid, or salt thereof may be selected from chloroacetic acid and sodium or potassium chloroacetate. The amount of halogen substituted $C_2$-$C_8$ carboxylic acid, ester, amide, or salt thereof relative to the amount of tertiary amine reactant may range from a molar ratio of about 1:0.1 to about 0.1:1.0.

The internal salts made according to the foregoing procedure may include, but are not limited to (1) hydrocarbyl substituted compounds of the formula R—$NMe_2CH_2COO$ where R is from $C_1$ to $C_{30}$; (2) fatty amide substituted internal salts; and (3) hydrocarbyl substituted imide, amide, or ester internal salts wherein the hydrocarbyl group has 8 to 40 carbon atoms. Particularly suitable internal salts may be selected from the group consisting of polyisobutenyl substituted succinimide, succinic diamide, and succinic diester internal salts; $C_8$-$C_{40}$ alkenyl substituted succinimide, succinic diamide, and succinic diester internal salts; oleyl amidopropyl dimethylamino internal salts; and oleyl dimethylamino internal salts.

Component (b)

Component (b) of the additive composition described herein may be a reaction product derived from (i) a hydrocarbyl substituted dicarboxylic acid, anhydride, or ester and (ii) an amine compound or salt thereof of the formula

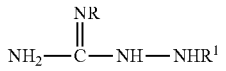

wherein R is selected from the group consisting of hydrogen and a hydrocarbyl group containing from about 1 to about 15 carbon atoms, and $R^1$ is selected from the group consisting of hydrogen and a hydrocarbyl group containing from about 1 to about 20 carbon atoms, wherein the reaction product (b) on average has less than 2 amino-triazole groups per molecule.

The hydrocarbyl substituted dicarboxylic acid, anhydride, or ester may be a hydrocarbyl carbonyl compound of the formula

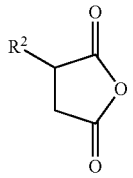

wherein $R^2$ is a hydrocarbyl group having a number average molecular weight ranging from about 200 to about 3000 wherein the reaction product of component (b) contains less than one equivalent of amino triazole group per molecule of reaction product.

In some aspects, the hydrocarbyl carbonyl compound may be a polyalkylene succinic anhydride reactant wherein $R^2$ is a hydrocarbyl moiety, such as for example, a polyalkenyl radical having a number average molecular weight of from about 100 to about 5,000. For example, the number average molecular weight of $R^2$ may range from about 200 to about 3,000, as measured by GPC. Unless indicated otherwise, molecular weights in the present specification are number average molecular weights.

The $R^2$ hydrocarbyl moiety may comprise one or more polymer units chosen from linear or branched alkenyl units. In some aspects, the alkenyl units may have from about 2 to about 10 carbon atoms. For example, the polyalkenyl radical may comprise one or more linear or branched polymer units chosen from ethylene radicals, propylene radicals, butylene radicals, pentene radicals, hexene radicals, octene radicals and decene radicals. In some aspects, the $R^2$ polyalkenyl radical may be in the form of, for example, a homopolymer, copolymer or terpolymer. In one aspect, the polyalkenyl radical is isobutylene. For example, the polyalkenyl radical may be a homopolymer of polyisobutylene comprising from about 10 to about 60 isobutylene groups, such as from about 20 to about 30 isobutylene groups. The polyalkenyl compounds used to form the $R^2$ polyalkenyl radicals may be formed by any suitable methods, such as by conventional catalytic oligomerization of alkenes.

In an additional aspect, the hydrocarbyl moiety $R^2$ may be derived from a linear alpha olefin or an acid-isomerized alpha olefin made by the oligomerization of ethylene by methods well known in the art. These hydrocarbyl moieties can range from about 8 carbon atoms to over 40 carbon atoms. For example, alkenyl moieties of this type may be derived from a linear $C_{18}$ or a mixture of $C_{20-24}$ alpha olefins or from acid-isomerized $C_{16}$ alpha olefins.

In some aspects, high reactivity polyisobutenes having relatively high proportions of polymer molecules with a terminal vinylidene group may be used to form the $R^2$ group. In one example, at least about 60%, such as about 70% to about 90%, of the polyisobutenes comprise terminal olefinic double bonds. There is a general trend in the industry to convert to high reactivity polyisobutenes, and well known high reactivity polyisobutenes are disclosed, for example, in U.S. Pat. No. 4,152,499, the disclosure of which is herein incorporated by reference in its entirety.

Specific examples of hydrocarbyl carbonyl compounds include such compounds as dodecenylsuccinic anhydrides, $C_{16-18}$ alkenyl succinic anhydride, and polyisobutenyl succinic anhydride (PIBSA). In some embodiments, the PIBSA may have a polyisobutylene portion with a vinylidene content ranging from about 4% to greater than about 90%. In some embodiments, the molar ratio of the number of carbonyl groups to the number of hydrocarbyl moieties in the hydrocarbyl carbonyl compound may range from about 0.5:1 to about 5:1.

In some aspects, approximately one mole of maleic anhydride may be reacted per mole of polyalkylene, such that the resulting polyalkenyl succinic anhydride has about 0.8 to about 1 succinic anhydride group per polyalkylene substituent. In other aspects, the molar ratio of succinic anhydride groups to alkylene groups may range from about 0.5 to about 3.5, such as from about 1 to about 1.1.

The hydrocarbyl carbonyl compounds may be made using any suitable method. Methods for forming hydrocarbyl carbonyl compounds are well known in the art. One example of a known method for forming a hydrocarbyl carbonyl compound comprises blending a polyolefin and maleic anhydride. The polyolefin and maleic anhydride reactants are heated to temperatures of, for example, about 150° C. to about 250° C., optionally, with the use of a catalyst, such as chlorine or peroxide. Another exemplary method of making the polyalkylene succinic anhydrides is described in U.S. Pat. No. 4,234,435, which is incorporated herein by reference in its entirety.

Suitable amine compounds form making component (b) may be chosen from guanidines and aminoguanidines or salts thereof. Accordingly, the amine compound may be chosen from the inorganic salts of guanidines, such as the halide, carbonate, nitrate, phosphate, and orthophosphate salts of guanidines. The term "guanidines" refers to guanidine and guanidine derivatives, such as aminoguanidine. In one embodiment, the guanidine compound for the preparation of the additive is aminoguanidine bicarbonate. Aminoguanidine bicarbonates are readily obtainable from commercial sources, or can be prepared in a well-known manner.

The hydrocarbyl carbonyl and amine compounds described above may be mixed together under suitable conditions to provide component (b) of the present disclosure. In one aspect of the present disclosure, the reactant compounds for component (b) may be mixed together in a mole ratio of hydrocarbyl carbonyl compound to amine ranging from about 1:0.5 to about 1:1.5. For example, the mole ratio of the reactants may range from about 1:0.5 to about 1:0.95.

Suitable reaction temperatures may range from about 130° C. to less than about 200° C. at atmospheric pressure. For example, reaction temperatures may range from about 140° C. to about 160° C. Any suitable reaction pressures may be used, such as, including subatmospheric pressures or superatmospheric pressures. However, the range of temperatures may be different from those listed where the reaction is carried out at other than atmospheric pressure. The reaction may be carried out for a period of time within the range of about 1 hour to about 8 hours, preferably, within the range of about 2 hours to about 6 hours.

The component (b) reaction product may be characterized by an FTIR spectrum having a peak intensity in a region of from about 1630 $cm^{-1}$ to about 1645 $cm^{-1}$ that ranges from about 5 to about 45% of peak intensities of other peak in a region of from about 1500 $cm^{-1}$ to about 1800 $cm^{-1}$. For example, component (b) may have a peak intensity in the region of from 1630 $cm^{-1}$ to about 1645 $cm^{-1}$ that ranges from about 5 to about 45% of peak intensities of other peaks in a region of from about 1500 $cm^{-1}$ to about 1800 $cm^{-1}$. In other embodiments, component (b) may have a characteristic peak intensity in the range of from 1630 $cm^{-1}$ to about 1645 $cm^{-1}$ that is no more than 30%, for example no more than 25%, and typically no more than 10% of the intensity of other peaks in the range of from about 1500 $cm^{-1}$ to about 1800 $cm^{-1}$.

The amount of components (a) and (b) in the fuel or fuel additive concentrate may range from a weight ratio of 10:1 to 1:10, for example from about 5:1 to about 1:5 by weight. Other useful weight ratios of (a) to (b) in a fuel may range from 2:1 to 1:4 and from 1:1 to 1:2.

In some aspects of the present application, the components (a) and (b) of the additive compositions of this disclosure may be used in combination with a fuel soluble carrier. Such carriers may be of various types, such as liquids or solids, e.g., waxes. Examples of liquid carriers include, but are not limited to, mineral oil and oxygenates, such as liquid polyalkoxylated ethers (also known as polyalkylene glycols or polyalkylene ethers), liquid polyalkoxylated phenols, liquid polyalkoxylated esters, liquid polyalkoxylated amines, and mixtures thereof. Examples of the oxygenate carriers may be found in U.S. Pat. No. 5,752,989, issued May 19, 1998 to Henly et. al., the description of which carriers is herein incorporated by reference in its entirety. Additional examples of oxygenate carriers include alkyl-substituted aryl polyalkoxylates described in U.S. Patent Publication No. 2003/0131527, published Jul. 17, 2003 to Colucci et. al., the description of which is herein incorporated by reference in its entirety.

In other aspects, the additive compositions of (a) and (b) may not contain a carrier. For example, some additive compositions of the present disclosure may not contain mineral oil or oxygenates, such as those oxygenates described above.

One or more additional optional compounds may be present in the fuel compositions of the disclosed embodiments. For example, the fuels may contain conventional quantities of cetane improvers, corrosion inhibitors, cold flow improvers (CFPP additive), pour point depressants, solvents, demulsifiers, lubricity additives, friction modifiers, amine stabilizers, combustion improvers, dispersants, antioxidants, heat stabilizers, conductivity improvers, metal deactivators, marker dyes, organic nitrate ignition accelerators, cyclomatic manganese tricarbonyl compounds, and the like. In some aspects, the compositions described herein may contain about 10 weight percent or less, or in other aspects, about 5 weight percent or less, based on the total weight of the additive concentrate, of one or more of the above additives. Similarly, the fuels may contain suitable amounts of conventional fuel blending components such as methanol, ethanol, dialkyl ethers, and the like.

In some aspects of the disclosed embodiments, organic nitrate ignition accelerators that include aliphatic or cycloaliphatic nitrates in which the aliphatic or cycloaliphatic group is saturated, and that contain up to about 12 carbons may be used. Examples of organic nitrate ignition accelerators that may be used are methyl nitrate, ethyl nitrate, propyl nitrate, isopropyl nitrate, allyl nitrate, butyl nitrate, isobutyl nitrate, sec-butyl nitrate, tert-butyl nitrate, amyl nitrate, isoamyl nitrate, 2-amyl nitrate, 3-amyl nitrate, hexyl nitrate, heptyl nitrate, 2-heptyl nitrate, octyl nitrate, isooctyl nitrate, 2-ethylhexyl nitrate, nonyl nitrate, decyl nitrate, undecyl nitrate, dodecyl nitrate, cyclopentyl nitrate, cyclohexyl nitrate, methylcyclohexyl nitrate, cyclododecyl nitrate, 2-ethoxyethyl nitrate, 2-(2-ethoxyethoxy)ethyl nitrate, tetrahydrofuranyl nitrate, and the like. Mixtures of such materials may also be used.

Examples of suitable optional metal deactivators useful in the compositions of the present application are disclosed in U.S. Pat. No. 4,482,357 issued Nov. 13, 1984, the disclosure of which is herein incorporated by reference in its entirety. Such metal deactivators include, for example, salicylidene-o-aminophenol, disalicylidene ethylenediamine, disalicylidene propylenediamine, and N,N'-disalicylidene-1,2-diaminopropane.

Suitable optional cyclomatic manganese tricarbonyl compounds which may be employed in the compositions of the present application include, for example, cyclopentadienyl manganese tricarbonyl, methylcyclopentadienyl manganese tricarbonyl, indenyl manganese tricarbonyl, and ethylcyclopentadienyl manganese tricarbonyl. Yet other examples of suitable cyclomatic manganese tricarbonyl compounds are disclosed in U.S. Pat. No. 5,575,823, issued Nov. 19, 1996, and U.S. Pat. No. 3,015,668, issued Jan. 2, 1962, both of which disclosures are herein incorporated by reference in their entirety.

Other commercially available detergents may be used in combination with additive components (a) and (b) as described herein. Such detergents include but are not limited to succinimides, Mannich base detergents, quaternary ammonium detergents, bis-aminotriazole detergents as generally described in U.S. patent application Ser. No. 13/450,638.

When formulating the fuel compositions of this application, the additive composition of (a) and (b) may be employed in amounts sufficient to reduce or inhibit deposit formation in a fuel system or combustion chamber of an engine and/or crankcase. In some aspects, the fuels may contain minor amounts of the above described additive composition that controls or reduces the formation of engine deposits, for example injector deposits in diesel engines. For example, the diesel fuels of this application may contain, on an active ingredient basis, a total amount of the additive composition of components (a) and (b) in the range of about 5 mg to about 500 mg of additive composition per Kg of fuel, such as in the range of about 10 mg to about 150 mg of per Kg of fuel or in the range of from about 30 mg to about 100 mg of the additive composition per Kg of fuel. In aspects, where a carrier is employed, the fuel compositions may contain, on an active ingredients basis, an amount of the carrier in the range of about 1 mg to about 100 mg of carrier per Kg of fuel, such as about 5 mg to about 50 mg of carrier per Kg of fuel. The active ingredient basis excludes the weight of (i) unreacted components associated with and remaining in additive composition, and (ii) solvent(s), if any, used in the manufacture of the additive composition either during or after its formation but before addition of a carrier, if a carrier is employed.

The additive compositions of the present application, including components (a) and (b) described above, and optional additives used in formulating the fuels of this invention may be blended into the base diesel fuel individually or in various sub-combinations. In some embodiments, the additive components of the present application may be blended into the diesel fuel concurrently using an additive concentrate, as this takes advantage of the mutual compatibility and convenience afforded by the combination of ingredients when in the form of an additive concentrate. Also, use of a concentrate may reduce blending time and lessen the possibility of blending errors.

The fuels of the present application may be applicable to the operation of diesel engine. The engine include both stationary engines (e.g., engines used in electrical power generation installations, in pumping stations, etc.) and ambulatory engines (e.g., engines used as prime movers in automobiles, trucks, road-grading equipment, military vehicles, etc.). For example, the fuels may include any and all middle distillate fuels, diesel fuels, biorenewable fuels, biodiesel fuel, gas-to-liquid (GTL) fuels, jet fuel, alcohols, ethers, kerosene, low sulfur fuels, synthetic fuels, such as Fischer-Tropsch fuels, liquid petroleum gas, bunker oils, coal to liquid (CTL) fuels, biomass to liquid (BTL) fuels, high asphaltene fuels, fuels derived from coal (natural, cleaned, and petcoke), genetically engineered biofuels and crops and extracts therefrom, and natural gas. "Biorenewable fuels" as used herein is understood to mean any fuel which is derived from resources other than petroleum. Such resources include, but are not limited to, corn, maize, soybeans and other crops; grasses, such as switchgrass, miscanthus, and hybrid grasses; algae, seaweed, vegetable oils; natural fats; and mixtures thereof. In an aspect, the biorenewable fuel can comprise monohydroxy alcohols, such as those comprising from 1 to about 5 carbon atoms. Non-limiting examples of suitable monohydroxy alcohols include methanol, ethanol, propanol, n-butanol, isobutanol, t-butyl alcohol, amyl alcohol, and isoamyl alcohol.

Diesel fuels that may be used include low sulfur diesel fuels and ultra low sulfur diesel fuels. A "low sulfur" diesel fuel means a fuel having a sulfur content of 50 ppm by weight or less based on a total weight of the fuel. An "ultra low sulfur" diesel fuel (ULSD) means a fuel having a sulfur content of 15 ppm by weight or less based on a total weight of the fuel. In another embodiment, the diesel fuels are substantially devoid of biodiesel fuel components.

Accordingly, aspects of the present application are directed to methods for reducing the amount of injector deposits of engines having at least one combustion chamber and one or more direct fuel injectors in fluid connection with the combustion chamber. In another aspect, the additive containing components (a) and (b) described herein may be combined with succinimide detergents, derivatives of succinimide detergents, and/or quaternary ammonium salts having one or more polyolefin groups; such as quaternary ammonium salts of polymonoolefins, polyhydrocarbyl succinimides; polyhydrocarbyl Mannich compounds: polyhydrocarbyl amides and esters. The foregoing quaternary ammonium salts may be disclosed for example in U.S. Pat. Nos. 3,468,640; 3,778,371; 4,056,531; 4171,959; 4,253,980; 4,326,973; 4,338,206; 4,787,916; 5,254,138: 7,906,470; 7,947,093; 7,951,211; U.S. Publication No. 2008/0113890; European Patent application Nos. EP 0293192; EP 2033945; and PCT Application No. WO 2001/110860.

In some aspects, the methods comprise injecting a hydrocarbon-based compression ignition fuel comprising the additive composition of the present disclosure through the injectors of the diesel engine into the combustion chamber, and igniting the compression ignition fuel. In some aspects, the method may also comprise mixing into the diesel fuel at least one of the optional additional ingredients described above.

The fuel compositions described herein are suitable for both direct and indirect injected diesel engines. The direct injected diesel engines include high pressure common rail direct injected engines.

In one embodiment, the diesel fuels of the present application may be essentially free, such as devoid, of conventional succinimide dispersant compounds. In another embodiment, the fuel is essentially free of quaternary ammonium salts of a hydrocarbyl succinimide or quaternary ammonium salts of a hydrocarbyl Mannich. The term "essentially free" is defined for purposes of this application to be concentrations having substantially no measurable effect on injector cleanliness or deposit formation.

EXAMPLES

The following examples are illustrative of exemplary embodiments of the disclosure. In these examples as well as elsewhere in this application, all parts and percentages are by weight unless otherwise indicated. It is intended that these examples are being presented for the purpose of illustration only and are not intended to limit the scope of the invention disclosed herein.

Comparative Example 1

A 950 molecular weight polybutenyl succinic anhydride (295 grams) was mixed with 86 grams (2 equivalents) aminoguanidine bicarbonate (AGBC) and 416 grams of aromatic solvent 150. The mixture was heated under vacuum to 165° C. and held at that temperature for about 4 hours, removing water and carbon dioxide. The resulting mixture was filtered. An FTIR spectrum of the product shows a peak at 1636 $cm^{-1}$ that dominates the peaks in a region from 1500 $cm^{-1}$ to 1800 $cm^{-1}$.

Component (a) Example 1

A mixture of oleyl amidopropyl dimethylamine (OD, 366 grams) and sodium chloroacetate (SCA, 113 grams) was heated in a mixture of isopropanol (125 mL) and water (51 grams) at 80° C. for 5.5 hours. Isopropanol (600 mL) and 2-ethylhexanol (125 grams) were added and the mixture was concentrated by heating to remove water. The resultant mixture was filtered through CELITE 512 filter medium to give product as a yellow oil.

Component (a) Example 2

The reaction product was made similar to Component (a) Example 1 with the exception that OD was replaced with oleyl dimethylamine. The reaction product was mixed with an aromatic solvent and 2-ethylhexanol to provide a yellow liquid.

Component (b) Example 3

A flask was charged with 950 molecular weight polybutenyl succinic anhydride (553 grams), aromatic solvent 150 (210 grams), aminoguanidine bicarbonate (AGBC) (79.5 grams, 1 equivalent), and toluene (145 grams). The reaction mixture was heated up to 145° C. and held for about 2 hours. No more water was removed through azeotrope distillation. A sample was removed and diluted with about an equal weight of heptane. The resulting mixture was filtered through CELITE 512 filter medium and concentrated by a rotary evaporator to give desired product as a brownish oil. An FTIR spectrum of the product showed peaks at 1724, 1689, 1637, 1588 $cm^{-1}$ with the peak at 1637 $cm^{-1}$ being the smallest.

Component (b) Example 4

The reaction product was made similar to Component (b) Example 3 with the exception that 36 grams of aminoguanidine bicarbonate (AGBC) was used.

In the following example, an injector deposit test was performed on a diesel engine using an industry standard diesel engine fuel injector test, CEC F-98-08 (DW10) as described below.

Diesel Engine Test Protocol

A DW10 test that was developed by Coordinating European Council (CEC) was used to demonstrate the propensity of fuels to provoke fuel injector fouling and was also used to demonstrate the ability of certain fuel additives to prevent or control these deposits. Additive evaluations used the protocol of CEC F-98-08 for direct injection, common rail diesel engine nozzle coking tests. An engine dynamometer test stand was used for the installation of the Peugeot DW10 diesel engine for running the injector coking tests. The engine was a 2.0 liter engine having four cylinders. Each combustion chamber had four valves and the fuel injectors were DI piezo injectors have a Euro V classification.

The core protocol procedure consisted of running the engine through a cycle for 8-hours and allowing the engine to soak (engine off) for a prescribed amount of time. The foregoing sequence was repeated four times. At the end of each hour, a power measurement was taken of the engine while the engine was operating at rated conditions. The injector fouling propensity of the fuel was characterized by a difference in observed rated power between the beginning and the end of the test cycle.

Test preparation involved flushing the previous test's fuel from the engine prior to removing the injectors. The test injectors were inspected, cleaned, and reinstalled in the engine. If new injectors were selected, the new injectors were put through a 16-hour break-in cycle. Next, the engine was started using the desired test cycle program. Once the engine was warmed up, power was measured at 4000 RPM and full load to check for full power restoration after cleaning the injectors. If the power measurements were within specification, the test cycle was initiated. The following Table 1 provides a representation of the DW10 coking cycle that was used to evaluate the fuel additives according to the disclosure.

TABLE 1

One hour representation of DW10 coking cycle.

| Step | Duration (minutes) | Engine speed (rpm) | Load (%) | Torque (Nm) | Boost air after Intercooler (° C.) |
|---|---|---|---|---|---|
| 1 | 2 | 1750 | 20 | 62 | 45 |
| 2 | 7 | 3000 | 60 | 173 | 50 |
| 3 | 2 | 1750 | 20 | 62 | 45 |
| 4 | 7 | 3500 | 80 | 212 | 50 |
| 5 | 2 | 1750 | 20 | 62 | 45 |
| 6 | 10 | 4000 | 100 | * | 50 |
| 7 | 2 | 1250 | 10 | 25 | 43 |
| 8 | 7 | 3000 | 100 | * | 50 |
| 9 | 2 | 1250 | 10 | 25 | 43 |
| 10 | 10 | 2000 | 100 | * | 50 |
| 11 | 2 | 1250 | 10 | 25 | 43 |
| 12 | 7 | 4000 | 100 | * | 50 |

Various fuel additives were tested using the foregoing engine test procedure in an ultra low sulfur diesel fuel containing zinc neodecanoate, 2-ethylhexyl nitrate, and a fatty acid ester friction modifier (base fuel). A "dirty-up" phase consisting of base fuel only with no additive was initiated, followed by a "clean-up" phase consisting of the base fuel plus additive(s). All runs were made with 8 hour dirty-up and 8 hour clean-up unless indicated otherwise. The percent power recovery was calculated using the power measurement at end of the "dirty-up" phase and the power measurement at end of the "clean-up" phase. The percent power recovery was determined by the following formula $$\text{Percent Power recovery}=(DU-CU)/DU\times 100$$

wherein DU is a percent power loss at the end of a dirty-up phase without the additive, CU is the percent power loss at the end of a clean-up phase with the fuel additive, and power is measured according to CEC F98-08 DW10 test.

TABLE 2

| Run No. | Additives and treat rate (ppm by weight) | DU % Power Change | CU % Power Change | % power Recovery |
|---|---|---|---|---|
| 1 | Compound of Comparative Example 1 (120 ppm) (32 hour dirty up and 32 hour clean up) | −5.39 | −5.08 | 6 |
| 2 | Component (a) Example 2 (25 ppm) | −3.71 | −3.79 | −2 |
| 3 | Component (a) Example 1 (50 ppm) | −5.10 | −5.22 | −2 |
| 4 | Component (a) Example 1 (20 ppm) | −4.60 | −5.86 | −27 |
| 5 | Component (b) Example 3 (95 ppm) | −6.06 | −3.06 | 50 |
| 6 | Component (b) Example 4 (150 ppm) | −4.82 | −2.28 | 53 |
| 7 | Comparative Example 1 (75 ppm) and Component (a) Example 1 (20 ppm) | −4.66 | −4.08 | 12 |
| 8 | Mixture of Component (a) Example 1 (20 ppm) and Component (b) Example 3 (75 ppm) | −3.66 | 1.08 | 130 |
| 9 | Mixture of Component (a) Example 1 (20 ppm) and Component (b) Example 3 (75 ppm) | −5.68 | 0.95 | 117 |
| 10 | Mixture of Component (a) Example 1 (20 ppm) and Component (b) Example 3 (75 ppm) | −5.74 | −0.54 | 91 |
| 11 | Mixture of Component (a) Example 1 (20 ppm) and Component (b) Example 3 (20 ppm) | −5.73 | −0.03 | 99 |
| 12 | Mixture of Component (a) Example 1 (50 ppm) and Component (b) Example 3 (10 ppm) | −4.96 | 1.84 | 137 |
| 13 | Mixture of Component (a) Example 1 (20 ppm) and Component (b) Example 4 (75 ppm) | −4.08 | 0.15 | 104 |
| 14 | Mixture of Component (a) Example 2 (20 ppm) and Component (b) Example 3 (75 ppm) | −4.58 | 0.49 | 111 |

As shown by the foregoing inventive Runs 8-14, a detergent mixture containing components (a) and (b) provides significant improvement in power loss recovery compared to a conventional dispersant added to the fuel as shown in Run 1 and compared to the arithmetic sum of the individual components (a) and (b) added to the fuel alone as shown in Runs 2-6. Each of the Runs 8-14 showed a synergistic increase in power recovery over what would be expected from adding the power recovery of the individual components (a) and (b). Run 7 shows that a combination of component (a) and the compound of Comparative Example 1 does not provide the synergistic result obtained when component (a) is combined with component (b).

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. An additive concentrate for a fuel for use in a injected fuel engine comprising (a) a hydrocarbyl substituted quaternary ammonium internal salt, wherein the quaternary ammonium internal salt is substantially free of non-covalently bonded anion species and comprises a reaction product of a hydrocarbyl substituted compound containing at least one tertiary amino group and a halogen substituted $C_2$-$C_8$ carboxylic acid, ester, amide, or salt thereof; and (b) a reaction product derived from (i) a hydrocarbyl substituted dicarboxylic acid, anhydride, or ester and (ii) an amine compound or salt thereof of the formula

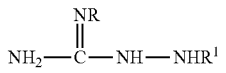

wherein R is selected from the group consisting of hydrogen and a hydrocarbyl group containing from about 1 to about 15 carbon atoms, and $R^1$ is selected from the group consisting of hydrogen and a hydrocarbyl group containing from about 1 to about 20 carbon atoms, wherein the reaction product (b) on average has less than 1 amino-triazole group per molecule, and wherein a weight ratio of (a) to (b) in the additive concentrate ranges from about 10:1 to about 1:10.

2. The additive concentrate of claim 1, wherein the hydrocarbyl substituent of the hydrocarbyl substituted quaternary ammonium internal salt comprises a hydrocarbyl-substituted, carbonyl-containing substituent selected from the group consisting of acylated polyamines, fatty amide tertiary amines, fatty acid substituted tertiary amines, and fatty ester tertiary amines.

3. The additive concentrate of claim 1, wherein the internal salt is selected from the group consisting of (1) hydrocarbyl substituted compounds of the formula $R—NMe_2CH_2COO$ where R is from $C_1$ to $C_{30}$; (2) fatty amide substituted internal salts; and (3) hydrocarbyl substituted imide, amide, or ester internal salts wherein the hydrocarbyl group has 8 to 40 carbon atoms.

4. The additive concentrate of claim 1, wherein the internal salt is selected from the group consisting of polyisobutenyl substituted succinimide, succinic diester, and succinic diamide internal salts; $C_8$-$C_{40}$ alkenyl substituted succinic internal salts; oleyl amidopropyl dimethylamino internal salts; and oleyl dimethylamino internal salts.

5. The additive concentrate of claim 1, wherein additive component (a) comprises an oleyl amidopropyl dimethylamino internal salt.

6. The additive concentrate of claim 1, wherein the amine (ii) in additive component (b) is aminoguanidine bicarbonate.

7. The additive concentrate of claim 1, wherein a molar ratio of (i) to (ii) in additive component (b) ranges from about 1:0.25 to about 1:1.5.

8. A diesel fuel composition comprising a major amount of a low sulfur diesel fuel and a minor amount of the additive concentrate of claim 1.

9. The diesel fuel composition of claim 8, wherein the amount of additive concentrate in the fuel ranges from about 5 to about 500 ppm by weight based on a total weight of fuel.

10. The diesel fuel of claim 8, wherein the low sulfur diesel is substantially devoid of biodiesel fuel components.

11. A method of cleaning up internal components of a fuel injector for a diesel engine comprising operating a fuel injected diesel engine on a fuel composition of claim 8.

12. A method of restoring power to a diesel fuel injected engine after an engine dirty-up phase comprising combusting in the engine a diesel fuel composition of claim 8, wherein the power restoration is measured by the following formula:

$$\text{Percent Power recovery}=(DU-CU)/DU\times 100$$

wherein DU is a percent power loss at the end of a dirty-up phase without the additive, CU is the percent power loss at the end of a clean-up phase with the fuel additive, and said power restoration is greater than 90%.

13. The method of claim 12, wherein the power restoration is measured as percent power recovery relative to the power before the dirty up phase and said power restoration is greater than 100%.

14. The method of claim 12, wherein the power restoration is measured as percent power recovery relative to the power before the dirty up phase and said power restoration is greater than 117%.

15. The method of claim 12, wherein the power restoration is measured as percent power recovery relative to the power before the dirty up phase and said power restoration is about 130%.

16. A method of improving the injector performance of a fuel injected diesel engine comprising operating the engine on a fuel composition comprising a major amount of fuel and from about 5 to about 500 ppm by weight based on a total weight of the fuel of a synergistic fuel additive comprising:

(a) a hydrocarbyl substituted quaternary ammonium internal salt, wherein the quaternary ammonium internal salt is substantially free of non-covalently bonded anion species and comprises a reaction product of a hydrocarbyl substituted compound containing at least one tertiary amino group and a halogen substituted $C_2$-$C_8$ carboxylic acid, ester, amide, or salt thereof; and (b) a reaction product derived from (i) a hydrocarbyl substituted dicarboxylic acid, anhydride, or ester and (ii) an amine compound or salt thereof of the formula

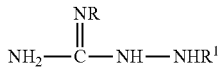

wherein R is selected from the group consisting of hydrogen and a hydrocarbyl group containing from about 1 to about 15 carbon atoms, and $R^1$ is selected from the group consisting of hydrogen and a hydrocarbyl group containing from about 1 to about 20 carbon atoms, wherein the reaction product (b) on average has less than 1 amino-triazole group per molecule, and wherein a weight ratio of (a) to (b) in the fuel additive ranges from about 10:1 to about 1:10, wherein when the synergistic additive(s) is present in the fuel, at least about 90% of the power lost during a dirty up phase of a CEC F98-08 DW10 test conducted in the absence of the synergistic additive(s) is recovered.

17. The method of claim 16, wherein the engine comprises a direct fuel injected diesel engine.

18. The method of claim 16, wherein the fuel comprises an ultra-low sulfur diesel fuel.

19. A method of operating a fuel injected diesel engine comprising combusting in the engine a fuel composition comprising a major amount of fuel and from about 5 to about 500 ppm by weight based on a total weight of the fuel of a synergistic fuel additive comprising:

(a) a hydrocarbyl substituted quaternary ammonium internal salt, wherein the quaternary ammonium internal salt is substantially free of non-covalently bonded anion species and comprises a reaction product of a hydrocarbyl substituted compound containing at least one tertiary amino group and a halogen substituted $C_2$-$C_8$ carboxylic acid, ester, amide, or salt thereof; and (b) a reaction product derived from (i) a hydrocarbyl substituted dicarboxylic acid, anhydride, or ester and (ii) an amine compound or salt thereof of the formula

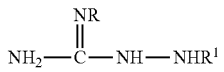

wherein R is selected from the group consisting of hydrogen and a hydrocarbyl group containing from about 1 to about 15 carbon atoms, and $R^1$ is selected from the group consisting of hydrogen and a hydrocarbyl group containing from about 1 to about 20 carbon atoms, wherein the reaction product (b) on average has less than 1 amino-triazole group per molecule, and wherein a weight ratio of (a) to (b) in the fuel additive ranges from about 10:1 to about 1:10.

20. The method of claim 19, wherein the internal salt is selected from the group consisting of polyisobutenyl substituted succinimide, succinic diamide, and succinic diester internal salts; $C_8$-$C_{40}$ alkenyl substituted succinimide, succinic diamide, and succinic diester internal salts; oleyl amidopropyl dimethylamino internal salts; and oleyl dimethylamino internal salts.

21. The method of claim 19, wherein the hydrocarbyl group of the hydrocarbyl-substituted quaternary ammonium internal salt may range from $C_8$ to $C_{40}$.

* * * * *